US006863492B2

(12) United States Patent
Ikeya

(10) Patent No.: US 6,863,492 B2
(45) Date of Patent: Mar. 8, 2005

(54) FRICTION REGENERATIVE PUMP

(75) Inventor: Masaki Ikeya, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 10/609,595

(22) Filed: Jul. 1, 2003

(65) Prior Publication Data

US 2004/0022641 A1 Feb. 5, 2004

(30) Foreign Application Priority Data

Jul. 31, 2002 (JP) ..... 2002-223832

(51) Int. Cl.[7] ..... F01D 1/12
(52) U.S. Cl. ..... 415/55.1; 415/172.1
(58) Field of Search ..... 415/55.1–55.7, 415/172.1, 174.4, 145

(56) References Cited

U.S. PATENT DOCUMENTS 2,455,552 A 12/1948 Bower
3,259,072 A 7/1966 Carpenter
4,325,672 A * 4/1982 Sixsmith et al. ..... 415/55.3
4,412,781 A * 11/1983 Abe et al. ..... 415/55.4
4,749,338 A * 6/1988 Galtz ..... 415/145
5,143,511 A * 9/1992 Verneau et al. ..... 415/55.4
5,498,124 A * 3/1996 Ito et al. ..... 415/55.1
5,527,150 A * 6/1996 Windhofer ..... 415/55.4

FOREIGN PATENT DOCUMENTS

JP 02009990 A 1/1990

OTHER PUBLICATIONS

German Office Action.

* cited by examiner

*Primary Examiner*—F. Daniel Lopez
*Assistant Examiner*—James M. McAleenan
(74) *Attorney, Agent, or Firm*—Rader, Fishman & Grauer PLLC

(57) ABSTRACT

A friction regenerative pump of this invention comprises: a partition portion formed in a section from a high-pressure outlet to a low-pressure intake along an impeller rotation direction; and a tongue portion provided in the partition portion such that it is elastically deformable. The tongue portion receives a back pressure from high-pressure fluid on the side of the high-pressure outlet and is elastically deformed in a direction of reducing a gap formed between the tongue portion and the outer peripheral portion of an impeller. Consequently, leakage of the high-pressure fluid from the high-pressure outlet to the low-pressure intake is reduced, thereby improving pump efficiency.

4 Claims, 4 Drawing Sheets

FRICTION REGENERATIVE PUMP

BACKGROUND OF THE INVENTION

1. Field of the Invention

The present invention relates to a friction regenerative pump for use as an electrically-driven fuel pump and more particularly to a friction regenerative pump having a structure intended to improve pump efficiency by reducing leakage of high-pressure fluid from a high pressure outlet to a low pressure intake.

2. Description of the Prior Art

FIG. 5 shows a lateral sectional view of major portions of a conventional side-channel type friction regenerative pump (so-called Wesco pump) and FIG. 6 shows a longitudinal sectional view of the same friction regenerative pump.

In the friction regenerative pump, an impeller (rotor) is rotated within a casing filled with fluid so as to provide the fluid with pressure energy. An outer peripheral end 21 of the impeller 2 is so constructed not to make a contact with an inner face 11 of the casing 1. In FIGS. 5, 6, reference numeral 3 denotes a low-pressure intake, reference numeral 4 denotes a high-pressure outlet, reference numeral 5 denotes a flow path formed in the casing 1, reference numeral 22 denotes a blade groove formed in the impeller 2 and reference numeral 23 denotes a vertical through hole.

However, because as described above, the outer peripheral end 21 of the impeller and the inner face 11 of the casing 1 are constructed not so as to contact each other, a gap 9 is formed between the outer peripheral end 21 of the impeller 2 and the inner face 11 of the casing 1 even in a partition portion (dead point) 6 formed in a section from the high-pressure outlet 4 to the low-pressure intake 3 along an impeller rotation direction a. Thus, high-pressure fluid existing on the side of the high-pressure outlet 4 leaks to the side of the low-pressure intake 3 through the gap 9, so that the leakage reduces its pump efficiency.

SUMMARY OF THE INVENTION

In views of the above-described problems, an object of the present invention is to provide a friction regenerative pump capable of improving the pump efficiency by reducing the leakage of high-pressure fluid from the high-pressure outlet to the low-pressure intake with a simple structure.

The friction regenerative pump of this invention is characterized in comprising: a partition portion formed in a section from a high-pressure outlet to a low-pressure intake along an impeller rotation direction; and a tongue portion provided in the partition portion such that it is elastically deformable, wherein the tongue portion receives a back pressure from the high-pressure fluid on the side of the high-pressure outlet and is elastically deformed in a direction of reducing a gap formed between the tongue portion and the outer peripheral portion of an impeller.

In the friction regenerative pump of this invention, the gap on the partition portion is elastically deformed when the tongue portion receives the back pressure from the high-pressure fluid and the volume thereof is reduced. Thus, leakage of the high-pressure fluid from the high-pressure outlet to the low-pressure intake is reduced due to reduction of the gap on the partition portion. Although the tongue portion is about to contact the outer peripheral end of the impeller due to its elastic deformation, the tongue portion receives a force in a direction of departing from the outer peripheral end of the impeller because of a wedge effect that the high-pressure fluid flows in between the tongue portion and the outer peripheral end of the impeller (when the width of the gap is narrowed in the flow direction, a pressure for supporting its load is generated). This force is increased as the pressure of the high-pressure fluid rises and the elastic deformation of the tongue portion is increased. Therefore, because basically, the tongue portion does not make a contact with the outer peripheral end of the impeller, such defects as obstructing a rotation of the impeller, generation of friction heat and abrasion of the tongue portion never occur. Further, because the tongue portion can follow up eccentricity and abrasion of the impeller, a drop in leakage reducing performance is never induced. Because when fluid contains a slight amount of foreign matter, the foreign matter can be removed by elastic deformation of the tongue portion, locking of the pump can be avoided.

The impeller side of the tongue portion is formed in a circular shape larger than the outside diameter of the impeller or in a linear shape along a tangent line on the outer periphery of the impeller, thereby the wedge effect being exerted.

The tongue portion may be formed integrally with or separately from the casing.

DESCRIPTION OF THE PREFERRED EMBODIMENTS

Figure 1:
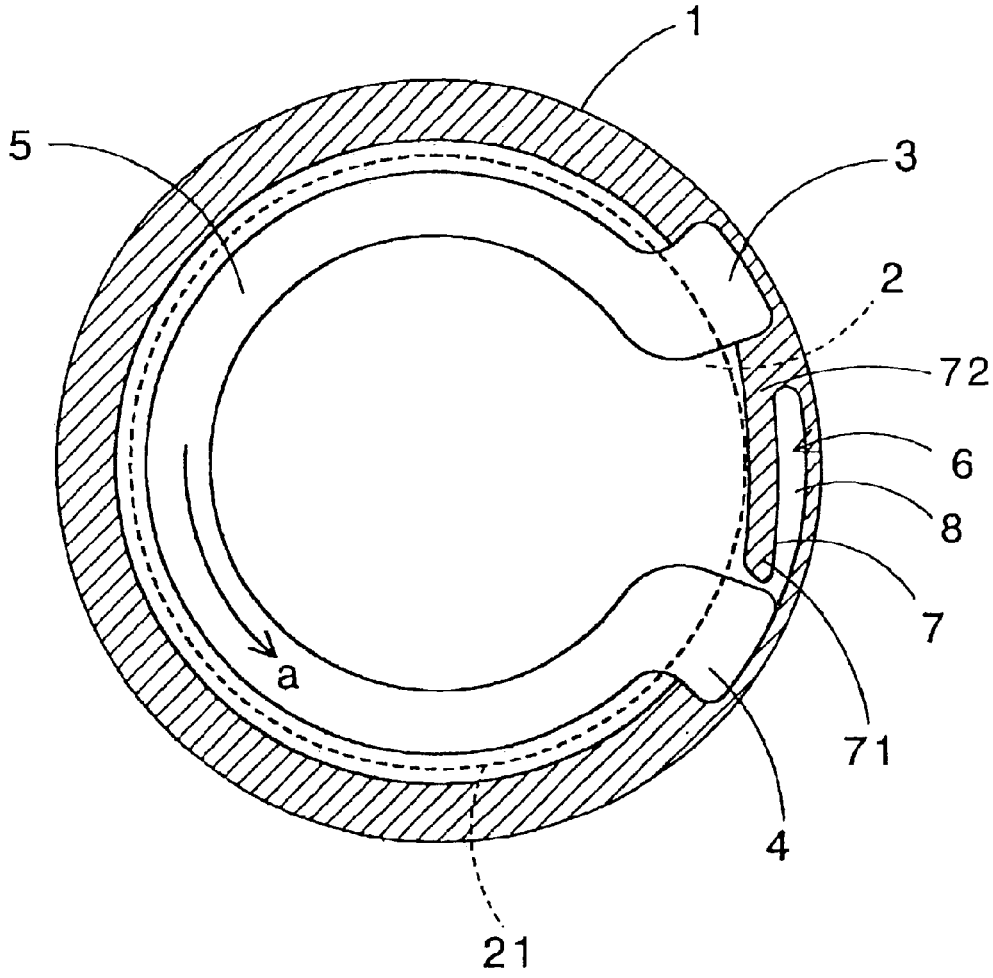
FIG. 1 is a lateral sectional view of major portions of the friction regenerative pump according to an embodiment of the present invention.

Referring to FIG. 1, reference numeral 1 denotes a casing made of metal such as aluminum or polyphenylene sulfide (PPS) resin of the friction regenerative pump and reference numeral 21 denotes an outer peripheral end of an impeller 2. In the casing 1, a low-pressure intake 3 for sucking low-pressure fluid is formed in the downstream and a high-pressure outlet 4 for discharging high-pressure fluid after pressurization is formed in the upstream. A flow path 5 which allows fluid to flow is formed in a section from the low-pressure intake 3 to the high-pressure outlet 4 along the impeller rotation direction a.

A partition portion 6 is formed in a section from the high-pressure outlet 4 to the low-pressure intake 3 along the impeller rotation direction a. The partition portion 6 contains an elastically deformable tongue portion 7 which is formed integrally with the resin casing 1. The tongue portion 7 is formed close to the outer periphery 21 of the impeller, in a circular shape larger than the diameter of the outer periphery of the impeller 2 or a linear shape along the tangent line of the outer periphery of the impeller 2 so as to form a wedge-like flow path. A leading edge portion 71 of the tongue portion 7 is formed so that it extends from a proximal portion 72 of the tongue portion 7 in a direction opposite to the impeller rotation direction a or to the side of the high-pressure outlet 4.

Figure 2:
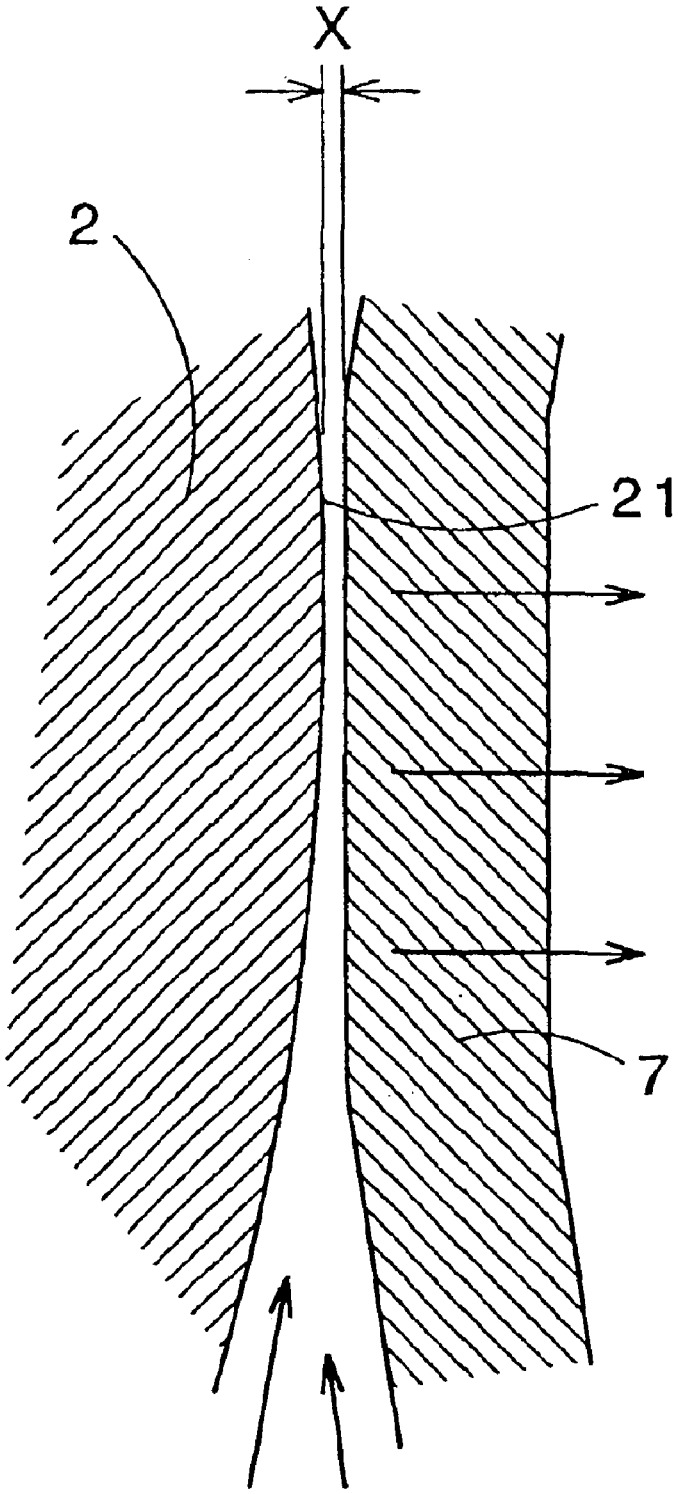
FIG. 2 is an explanatory diagram for explaining a wedge effect.
Figure 4:
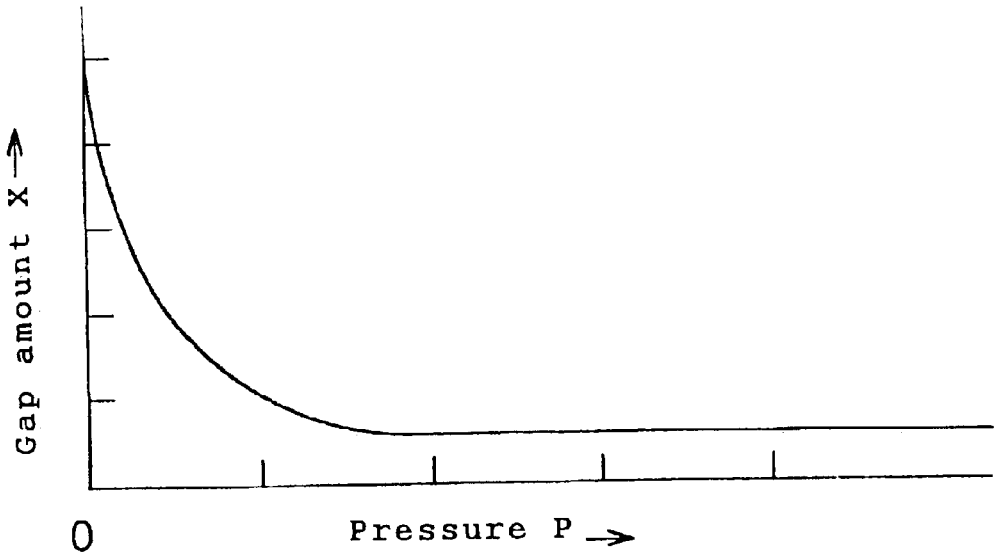
FIG. 4 is a graph indicating the relation between a pressure P of the high-pressure fluid and a gap amount X.
Figure 5:
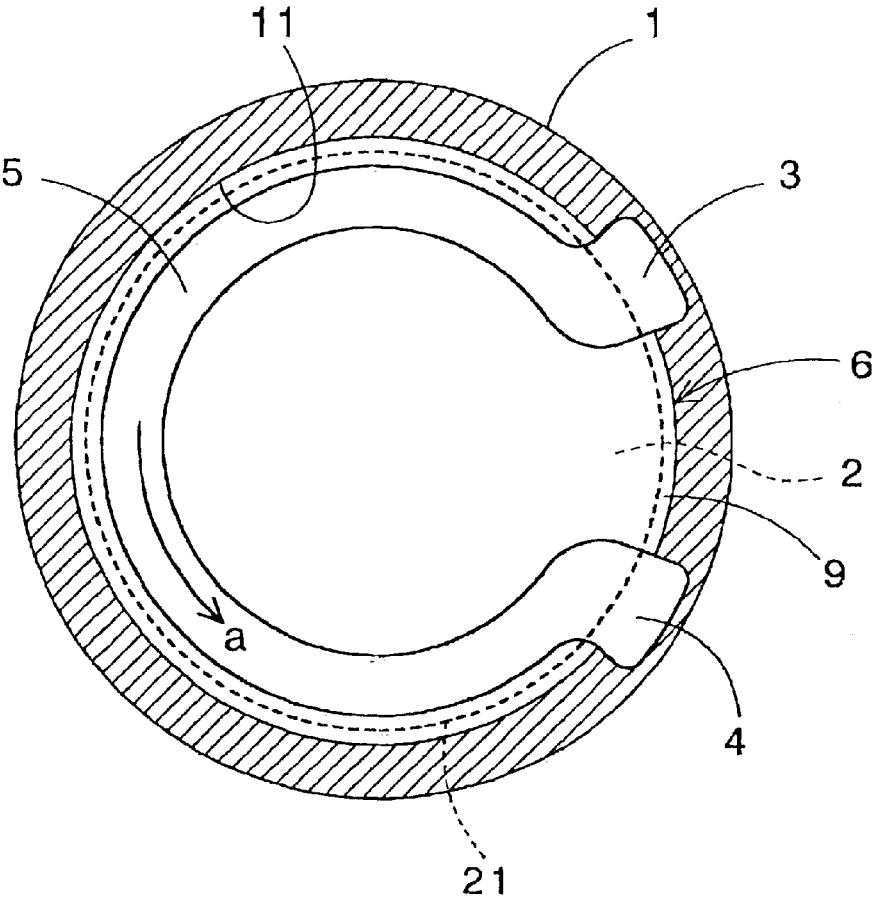
FIG. 5 is a lateral sectional view of major portions of a conventional friction regenerative pump.
Figure 6:
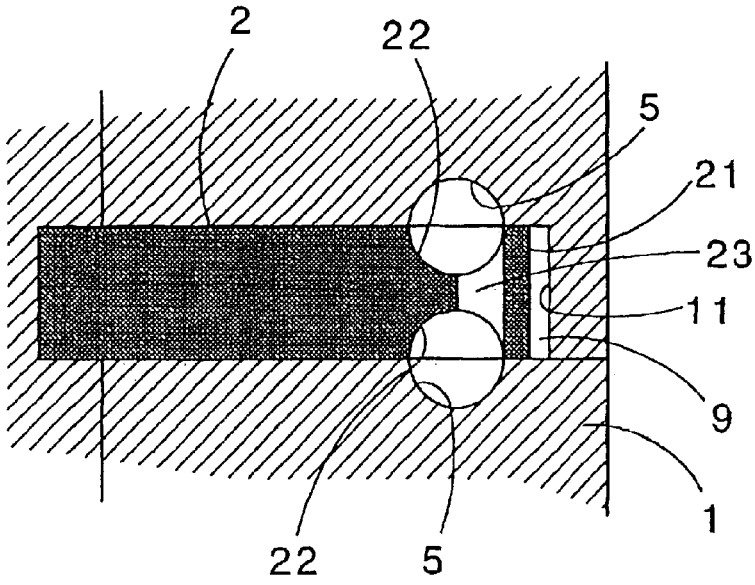
FIG. 6 is a longitudinal sectional view of major portions of the same friction regenerative pump.

Upon operation of the friction regenerative pump, the tongue portion 7 is elastically deformed in a direction of contacting the outer peripheral end 21 of the impeller 2 because it receives a back pressure by the high-pressure fluid in the high-pressure chamber 8 which communicates with the high-pressure outlet 4. Thus, the gap on the partition portion 6 is reduced, so that leakage of high-pressure fluid from the high-pressure outlet 4 to the low-pressure intake 3 is reduced. Further, the tongue portion 7 is about to make a contact with the outer peripheral portion 21 of the impeller 2 through its elastic deformation. However, due to the wedge effect that high-pressure fluid flows in between the tongue portion 7 and the outer peripheral portion 21 of the impeller 2 as shown in FIG. 2, the tongue portion 7 receives a force in a direction of departing from the outer peripheral end 21 of the impeller 2. This force is larger as the pressure of the high-pressure fluid is larger and the elastic deformation of the tongue portion 7 is more intensified. Therefore, the gap X between the tongue portion 7 and the outer peripheral end 21 of the impeller 2 has a relation indicated in FIG. 4 to the pressure P of the high-pressure fluid and basically, the tongue portion 7 does not contact the outer peripheral end 21 of the impeller 2. For the reason, such defects as obstructing a rotation of the impeller 2 by the tongue portion 7, generation of frictional heat and abrasion of the tongue portion 7 never occur. The tongue portion 7 can follow up eccentricity and abrasion of the impeller 2 through its elastic deformation. Thus, reduction in leakage reducing performance is not induced. Further, because if a slight amount of foreign matter is contained in fluid, that foreign matter can be removed by the elastic deformation of the tongue portion 7, locking of the pump can be avoided.

Figure 3:
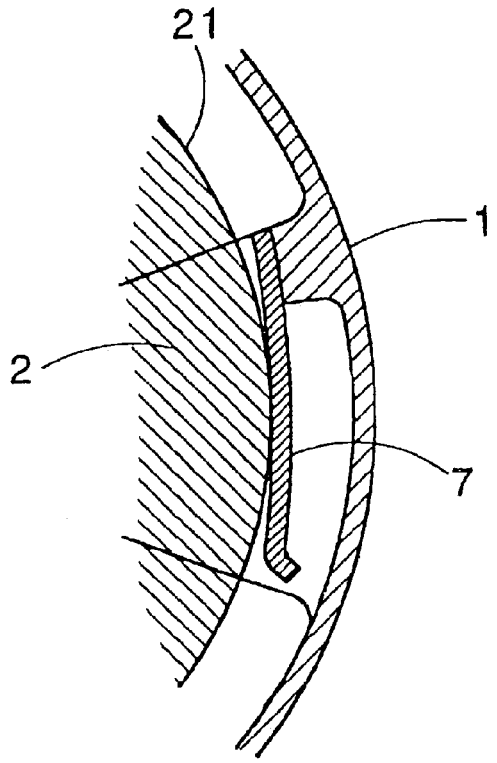
FIG. 3 is a structural diagram of a tongue portion according to a modification.

The tongue portion 7 may be constructed with a spring member separate from the casing 1 as shown in FIG. 3. This tongue portion 7 exerts the same operation and effect as described above and improves manufacturability and assembly performance.

As described above, the friction regenerative pump of this embodiment can improve pump efficiency by reducing leakage of high-pressure fluid from the high-pressure outlet to the low-pressure intake with a simple structure. Particularly, in case of a side channel type impeller, this effect is great.

What is claimed is:

1. A friction regenerative pump comprising:

a partition portion formed in a section from a high-pressure outlet to a low-pressure intake along an impeller rotation direction; and a tongue portion provided in said partition portion such that it is elastically deformable, wherein said tongue portion receives a back pressure from high-pressure fluid on the side of said high-pressure outlet and is elastically deformed in a direction of reducing a gap formed between said tongue portion and the outer peripheral portion of an impeller.

2. A friction regenerative pump according to claim 1 wherein the impeller side of said tongue portion is formed in a circular shape larger than the outside diameter of the impeller or in a linear shape along a tangent line of the outer periphery of the impeller.

3. A friction regenerative pump according to claim 1 or 2 wherein said tongue portion is constructed integrally with a casing.

4. A friction regenerative pump according to claim 1 or 2 wherein said tongue portion is constructed separately from the casing.

* * * * *